United States Patent [19]

Terada et al.

[11] Patent Number: 4,459,959

[45] Date of Patent: Jul. 17, 1984

[54] FUEL INJECTION SYSTEM

[75] Inventors: Tomohiko Terada; Hideaki Komada, both of Higashi Matsuyama, Japan

[73] Assignee: Diesel Kiki Company, Ltd., Tokyo, Japan

[21] Appl. No.: 339,347

[22] Filed: Jan. 15, 1982

[30] Foreign Application Priority Data

Jan. 24, 1981 [JP] Japan ..... 56-9167

[51] Int. Cl.[3] ..... F02M 39/00

[52] U.S. Cl. ..... 123/446; 123/447

[58] Field of Search ..... 123/446, 447, 458

[56] References Cited

U.S. PATENT DOCUMENTS

| | | | |
|---|---|---|---|
| 3,872,850 | 3/1975 | Littlehales | 123/458 |
| 3,943,901 | 3/1976 | Takahashi et al. | 123/447 |
| 4,069,800 | 1/1978 | Kanda et al. | 123/447 |
| 4,089,315 | 5/1978 | Lakra | 123/447 |
| 4,216,754 | 8/1980 | Lakra | 123/447 |
| 4,249,497 | 2/1981 | Eheim et al. | 123/446 |
| 4,297,982 | 11/1981 | Lakra | 123/446 |

FOREIGN PATENT DOCUMENTS

| | | | |
|---|---|---|---|
| 2253186 | 3/1973 | Fed. Rep. of Germany | 123/447 |
| 1262089 | 2/1972 | United Kingdom | 123/446 |

*Primary Examiner*—Ira S. Lazarus
*Assistant Examiner*—Magdalen Moy
*Attorney, Agent, or Firm*—Jordan & Hamburg

[57] ABSTRACT

A fuel injection system includes a booster for intensifying a supply of fuel from a fuel reservoir and a nozzle needle actuator for operating a fuel injector to start and terminate a fuel injection from the latter. The boosted fuel from the booster is fed not only to the fuel injector but to an upper chamber of the nozzle needle actuator which is defined by a piston. A first hydraulic circuit produces a variable hydraulic fluid pressure for operating the booster in accordance with a predetermined engine operating parameter. A lower chamber also defined by the piston in the nozzle needle actuator is selectively communicated to the first hydraulic circuit by a second hydraulic circuit. The first and second hydraulic circuits share a common source of hydraulic fluid supply which is independent of the fuel reservoir.

12 Claims, 2 Drawing Figures

FUEL INJECTION SYSTEM

BACKGROUND OF THE INVENTION

The present invention generally relates to fuel injection systems for Diesel engines and, more particularly, to a fuel injection system of the type which includes a booster for boosting the pressure of fuel to be supplied to a fuel injector and a nozzle needle actuator for controlling a fuel injection by the fuel injector in response to a control of a hydraulic fluid pressure applied thereto.

A fuel injection system of the type described is disclosed in Japanese Pat. application No. 55-87449. This prior art fuel injection system is constructed to operate the booster and nozzle needle actuator by a pressurized fluid which is the fuel to be injected. That is, fuel is circulated commonly through the additional lines for operating the booster and nozzle needle actuator in addition to the fuel supply line to the fuel injector. This is undesirable, however, in view of the current situation of worldwide oil supply and, therefore, the future use of crude fuel. Crude fuel would permit various impurities such as tar and pitch contained therein to become deposited on direction control valves, booster, nozzle needle actuator, pipings and the like, rendering the operations of such elements unsmooth or erroneous. This would critically affect the control over the fuel injection by the fuel injector.

SUMMARY OF THE INVENTION

A fuel injection system embodying the present invention includes a fuel reservoir, a booster operated by a pressure differential between opposite ends thereof to compress fuel fed from the fuel reservoir to one end thereof, a fuel circuit for feeding the fuel from the fuel reservoir to the one end of the booster, and a fuel injector for injecting a supply of compressed fuel from the booster. The fuel injection system further includes a nozzle needle actuator, a hydraulic fluid reservoir, a first hydraulic circuit, a second hydraulic circuit, and a control unit. The nozzle needle actuator is operatively associated with the fuel injector and operated by a pressure differential between opposite ends thereof to start and terminate a fuel injection by the fuel injector. The supply of compressed fuel from the booster is also fed to one end of the nozzle needle actuator to develop a fuel pressure at the one end thereof. The first hydraulic circuit is communicated with the hydraulic fluid reservoir to produce a variable hydraulic fluid pressure which is selectively fed to the other end of the booster through a first direction control valve as a first hydraulic fluid pressure.

In accordance with the present invention, a fuel injection system has a booster for intensifying a supply of fuel from a fuel reservoir and a nozzle needle actuator for operating a fuel injector to start and terminate a fuel injection from the latter. The boosted fuel from the booster is fed not only to the fuel injector but to an upper chamber of the nozzle needle actuator which is defined by a piston. A first hydraulic circuit produces a variable hydraulic fluid pressure for operating the booster in accordance with a predetermined engine operating parameter. A lower chamber also defined by the piston in the nozzle needle actuator is selectively communicated to the first hydraulic circuit by a second hydraulic circuit. The first and second hydraulic circuits share a common source of hydraulic fluid supply which is independent of the fuel reservoir.

It is an object of the present invention to provide a fuel injection system which can accommodate the expected use of crude fuel without affecting various elements allotted for the control of the fuel injection.

It is another object of the present invention to provide a simple hydraulic arrangement for operating the booster and nozzle needle actuator.

It is another object of the present invention to provide a generally improved fuel injection system.

Other objects, together with the foregoing, are attained in the embodiment described in the following description and illustrated in the accompanying drawings.

DESCRIPTION OF THE PREFERRED EMBODIMENT

While the fuel injection system of the present invention is susceptible of numerous physical embodiments, depending upon the environment and requirements of use, substantial numbers of the herein shown and described embodiment have been made, tested and used, and all have performed in an eminently satisfactory manner.

Figure 1:
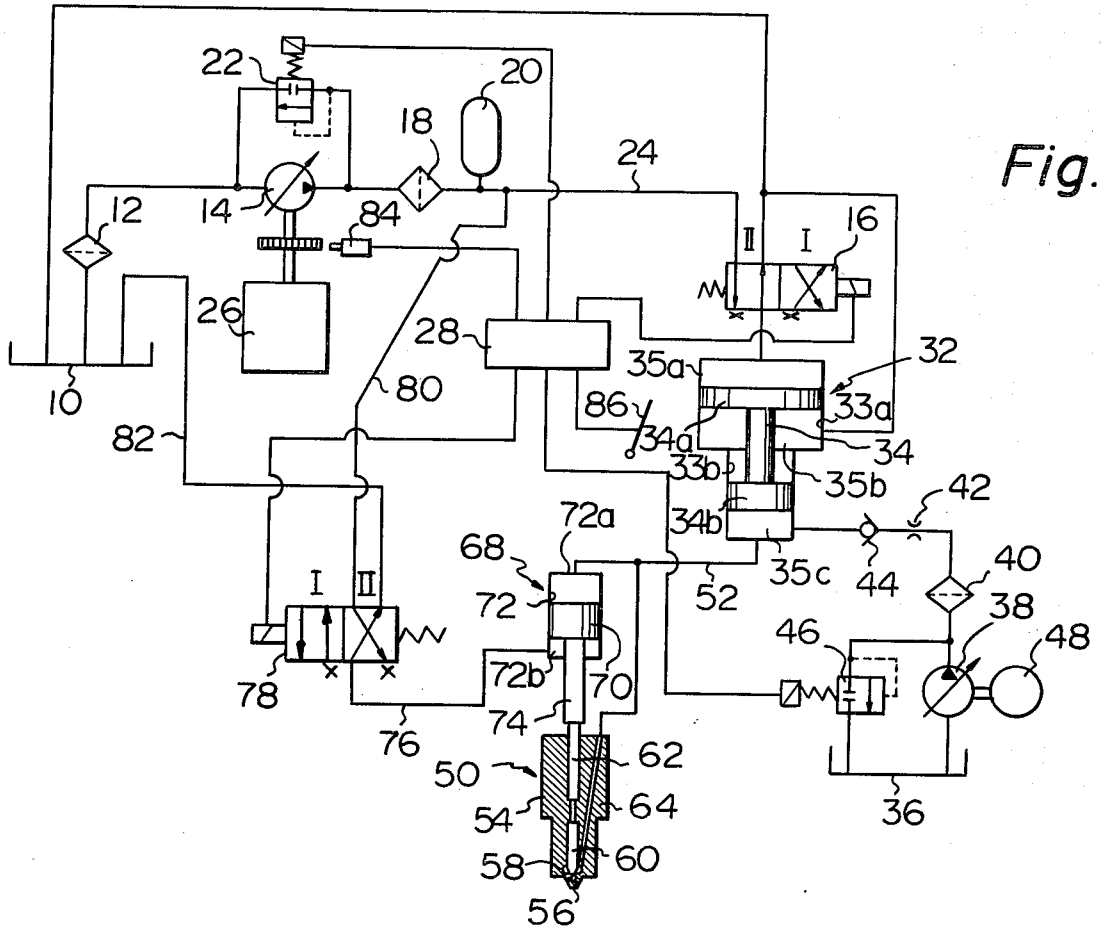
FIG. 1 is a diagram showing a general construction of a fuel injection system embodying the present invention.

Referring to FIG. 1 of the drawings, the fuel injection system includes a source of hydraulic fluid supply or a hydraulic fluid reservoir 10 which stores a hydraulic fluid substantially under atmospheric pressure for supplying various hydraulic units. The fluid reservoir 10 is communicated via a filter 12 to the suction port of a hydraulic pump 14 whose delivery port is communicated to an electromagnetically operated 2-position, 4-port direction control valve 16 via a filter 18 and an accumulator 20. An electronically operated relief valve 22 is hydraulically communicated with the delivery side of the pump 14. The fluid delivery line from the pump 14 to the direction control valve 16 will be referred to as a first hydraulic circuit and denoted by the reference numeral 24. The pump 14 is driven for rotation by an engine 26. Operated by a control unit 28 as will be described, the electronic relief valve 22 controls the fluid pressure in the first hydraulic circuit 24 in accordance with a varying load on the engine 26, i.e. full load, partial load and no load.

A booster generally designated by the reference numeral 32 comprises intercommunicated upper and lower bores 33*a* and 33*b* The upper bore 33*a* is larger in diameter than the lower bore 33*b*. A servo piston 34 is slidably disposed in the upper and lower intercommunicated bores 33*a* and 33*b* and has an upper piston 34*a* and a lower piston 34*b* which correspond in diameter to the upper and lower bores 34*a* and 34*b*, respectively. The upper piston 34*a* thus larger than the lower piston 34*b* defines a chamber 35*a* thereabove and a chamber 35*b* therebelow. The chamber 35*a* is selectively communicatable to the fluid reservoir 10 and the first hydraulic circuit 24 depending on the position of the direction control valve 16. The lower piston 34*b* on the other hand defines a chamber 35c therebelow for compressing a supply of fuel when the servo piston 34 strokes downward. This chamber 35c has fluid communication with a source of fuel supply or fuel reservoir 36 and a fuel injection nozzle or fuel injector 50.

The fuel reservoir 36 connects to a hydraulic pump 38 which in turn connects to the chamber 35c of the booster 32 via a filter 40, an orifice 42 and a check valve 44. A second electronically operated relief valve 46 is hydraulically communicated with the delivery side of the pump 38 and also controlled by the control unit 28 to maintain the delivery pressure at a controllable level. The pump 38 is driven by a drive 48 to suck and compress fuel from the fuel reservoir 36.

The direction control valve 16 has two positions I and II which are alternately selected by the control unit 28. In the position I of the valve 16, the upper piston chamber 35a of the booster 32 is allowed to communicate with the first hydraulic circuit 24 so that the fluid under controlled pressure from the circuit 24 is admitted in the piston chamber 35a to move the servo piston 34 downward. Then, the fuel filled in the chamber 35c is compressed or boosted and fed to the fuel injector 50 by way of a conduit 52 which constitutes a fuel circuit. In the position II of the valve 16, the piston chamber 35a is brought into communication with the low pressure fluid reservoir 10 while fuel is fed under pressure from the pump 38 into the compression chamber 35c. The booster 32 in this embodiment is designed such that a supply of fuel in the compression chamber 35c is boosted to a pressure which is about six times the controlled delivery pressure of the pump 38, when the position of the valve 16 is varied from II to I.

The fuel injector 50 comprises a nozzle body 54 which is formed with nozzle holes 56 and a fuel wall 58 contiguous with the nozzle holes 56. A nozzle needle 60 is slidably received in the nozzle body 54 and normally seated on a nozzle needle seat by a pressure imparted downwardly thereto from a pressure pin 62 so as to keep the nozzle holes 56 closed. A fuel induction passage 64 extends through the nozzle body 54 to provide a fluid communication between the conduit 52 and the fuel well 58.

In accordance with the present invention, the compressed fuel from the booster 32 is also fed to a nozzle needle actuator 68 which is operatively associated with the fuel injector.

The nozzle needle actuator 68 comprises a piston 70 which is slidably received in a bore 72. A rod 74 extends downward from the lower end of the piston 70 into constant engagement with the pressure pin 62 which is slidably received in the upper end of the nozzle body 54. The piston 70 divides the bore 72 into an upper chamber 72a and a lower chamber 72b. The upper chamber 72a is communicated with the compression chamber 35c of the booster 32 via the conduit 52. The lower chamber 72b is communicated with a second hydraulic circuit 76 which includes a second direction control valve 78. This direction control valve 78 is of the electromagnetically operated 2-position, 4-port type and has positions I and II as the first direction control valve 16. Also controlled by the control unit 28, the direction control valve 78 selectively communicates the lower chamber 72b of the nozzle needle actuator 68 to the first hydraulic circuit 24 downstream of the pump 14 via a fluid supply line 80 and to the fluid reservoir 10 via a fluid return line 82. The lines 80 and 82 constitute a second hydraulic circuit.

The upper chamber 72a of the nozzle needle actuator 68 is filled with fuel which is supplied under pressure from the compression chamber 35c of the booster 32 via the conduit 52. The pressure in the chamber 72a urges the piston 70 downward. At the same time, the fuel from the chamber 35c is communicated via the conduit 52 to the fuel well 58 of the fuel injector 50 so that the fuel pressure acting on the pressure stage of the nozzle needle 60 counteracts the fluid pressure in the chamber 72a. However, due to the effective area differential, the nozzle needle remains forced downward to block the nozzle holes 56.

An engine speed sensor 84 and a throttle position sensor 86 are electrically connected with the control unit 28 to supply electric signals indicative of an engine speed and throttle lever position, respectively. The control unit 28 processes these signals as well as others to produce control signals for actuating the direction control valves 16 and 78.

In operation, the pump 14 driven by the engine 26 sucks and compresses the fluid from the reservoir 10 while the relief valve 22 controls the delivery pressure of the pump in accordance with the engine load condition. This controlled fluid pressure is accumulated in the accumulator 20.

When the first direction control valve 16 is actuated by the control unit 28 from the II position to the I position, the fluid pressure in the circuit 24 is admitted in the piston chamber 35a of the booster 32 to cause the servo piston 34 into a downward stroke. Then, the boosted fuel is fed to the fuel injector 50 and nozzle needle actuator 68 via the conduit 52. It will be seen that the fluid pressure in the induction passage 64 and bore 58 of the fuel injector 50 is dependent on the volume of fluid which was admitted in the upper chamber 35a of the booster 32 in the II position of the selector 16. In the meantime, the second direction control valve 78 is in its II position providing a fluid communication between the lower chamber 72b of the nozzle needle actuator and the reservoir 10 via the fluid return line 82.

Figure 2:
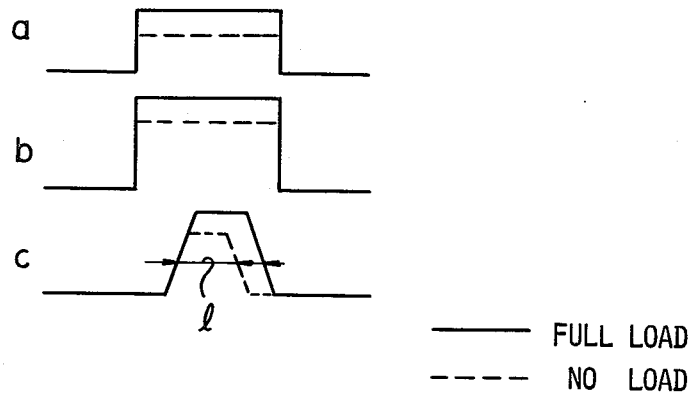
FIG. 2 is a timing chart demonstrating operations of a booster and a nozzle needle actuator included in the fuel injection system of FIG. 1 in terms of variations in hydraulic fluid pressure.

The fluid pressure in the upper and lower chambers 35a and 35c of the booster are varied as represented by waveforms a and b in FIG. 2, respectively; the solid lines indicating a full load condition and the phantom lines a no load condition.

When the second direction control valve 78 is operated by the control unit 28 to shift from the II position to the I, the pressurized fluid in the first hydraulic circuit 24 is fed through the fluid supply line 80 into the lower chamber 72b of the nozzle needle actuator to sharply increase the pressure therein. This fluid pressure cooperates with the fuel pressure in the fuel well 58 to move the piston 70 upward overcoming the fuel pressure inside the upper chamber 72a. As a result, the nozzle needle 60 is lifted clear of the nozzle seat whereby a fuel inejection is started from the nozzle holes 56.

As the direction control valve 78 is actuated by the control unit 28 to regain its I position, the lower chamber 72b is drained into the reservoir 10 via the fluid return line 82 resulting in an abrupt decrease in the fluid pressure. Then, the fuel pressure in the upper chamber 72a urges the piston 70 and, therefore, the nozzle needle 60 downward until the nozzle holes 56 are blocked again by the nozzle needle 60.

In this way, opening and closing of the nozzle holes 56 is controlled by the relationship between the fluid pressures acting on the opposite ends of the piston 70 of the nozzle needle actuator 68. For such a fuel injection control, the fluid pressure in the lower chamber 72*b* is varies as indicated by a waveform c in FIG. 2 in which l represents a duration of fuel injection.

In summary, it will be seen that the present invention provides a fuel injection system which can safeguard, with a simple construction and arrangement, various fuel injection control elements against deposition of impurities in spite of the current tendency to the use of crude fuel.

Various modifications will become possible for those skilled in the art after receiving the teachings of the present disclosure without departing from the scope thereof.

What is claimed is:

1. A fuel injection system comprising, in combination:

a source of fuel supply;

a booster operated by a pressure differential between opposite ends thereof to compress fuel fed from the source of fuel supply to one end thereof;

a fuel injector for injecting a supply of compressed fuel from the booster;

a nozzle needle actuator operatively assocaited with the fuel injector and operated by a pressure differential between opposite ends thereof to start and terminate a fuel injection by the fuel injector, the supply of compressed fuel from the booster being also fed to one end of the nozzle needle actuator to develop a fuel pressure at the one end thereof;

fuel circuit means for feeding the fuel from the source of fuel supply to the fuel injector and the one end of the nozzle needle actuator through the one end of the booster;

a source of hydraulic fluid supply;

first hydraulic circuit means communicated with the source of hydraulic fluid supply for producing a variable hydraulic fluid pre-sure, the variable hydraulic fluid pressure being fed to the other end of the booster as a first hydraulic fluid pressure to compress the fuel in the one end of the booster, the first hydraulic circuit means comprising a pump communicated with the source of hydraulic fluid supply at the suction port thereof;

second hydraulic circuit means for selectively communicating the other end of the nozzle needle actuator to the source of fluid supply and the first hydraulic circuit means to develop a second hydraulic fluid pressure at the other end of the nozzle needle actuator;

control means for controlling the first and second hydraulic fluid pressures in the first and second hydraulic circuit means; and a first direction control means controlled by the control means to selectively communicate the other end of the booster with the pump and the hydraulic fluid supply, the first direction control means comprising an electromagnetically operated 2-position, 4-port control valve.

2. A fuel injection system as claimed in claim 1, in which the pump is driven by an engine to generate the first hydraulic fluid pressure, the system further comprising a hydraulic fluid pressure control valve controlled by the control means to vary a delivery pressure of the pump.

3. A fuel injection system as claimed in claim 2, further comprising an engine speed sensor and a throttle level position sensor, said control means being constructed to further control the hydraulic fluid pressure control valve to vary the pump delievery pressure in accordance with at least one of the sensed engine speed and the sensed throttle level position.

4. A fuel injection system as claimed in claim 1, in which the fuel circuit means comprises a pump communicated with the source of fuel supply at the suction port thereof and the one end of the booster at the delivery port thereof.

5. A fuel injection system as claimed in claim 4, in which the pump is driven by a drive to generate the fuel pressure, the system further comprising a fuel pressure control valve controlled by the control means to maintain a delivery pressure of the pump at a controllable level.

6. A fuel injection system comprising, in combination:

a source of fuel supply;

a booster operated by a pressure differential between opposite ends thereof to compress fuel fed from the source of fuel supply to one end thereof;

a fuel injector for injecting a supply of compressed fuel from the booster;

a nozzle needle actuator operatively assocaited with the fuel injector and operated by a pressure differential between opposite ends thereof to start and terminate a fuel injection by the fuel injector, the supply of compressed fuel from the booster being also fed to one end of the nozzle needle actuator to develop a fuel pressure at the one end thereof;

fuel circuit means for feeding the fuel from the source of fuel supply to the fuel injector and the one end of the nozzle needle actuator through the one end of the booster;

a source of hydraulic fluid supply;

first hydraulic circuit means communicated with the source of hydraulic fluid supply for producing a variable hydraulic fluid pressure, the variable hydraulic fluid pressure being fed to the other end of the booster as a first hydraulic fluid pressure to compress the fuel in the one end of the booster, the first hydraulic circuit means comprising a pump communicated with the source of hydraulic fluid supply at the suction port thereof;

second hydraulic circuit means for selectively communicating the other end of the nozzle needle actuator to the source of fluid supply and the first hydraulic circuit means to develop a second hydraulic fluid pressure at the other end of the nozzle needle actuator;

control means for controlling the first and second hydraulic fluid pressures in the first and second hydraulic circuit means; and a first direction control means controlled by the control means to selectively communicate the other end of the booster with the pump and the hydraulic fluid supply, the second hydraulic circuit means comprising a second direction control means controlled by the control means to selectively communicate the other end of the nozzle needle actuator with the pump and the hydraulic fluid supply, the second direction control means comprising an electromagnetically operated 2-position, 4-port control valve.

7. A fuel injection system as claimed in claim 1, in which the second hydraulic circuit means comprises a second direction control means controlled by the control means to selectively communicate the other end of the nozzle needle actuator with the pump and the hydraulic fluid supply.

8. A fuel injection system as claimed in claim 6, in which the first direction control means comprises an electromagnetically operated 2-position, 4-port control valve.

9. A fuel injection system as claimed in claim 6, in which the pump is driven by an engine to generate the first hydraulic fluid pressure, the system further comprising a hydraulic fluid pressure control valve controlled by the control means to vary the delivery pressure of the pump.

10. A fuel injection system as claimed in claim 9, further comprising an engine speed sensor and a throttle level position sensor, said control means being constructed to further control the hydraulic fluid pressure control valve to vary the pump delivery pressure in accordance with at least one of the sensed engine speed and the sensed throttle level position.

11. A fuel injection system as claimed in claim 6, in which the fuel circuit means comprises a pump communicated with the source of fuel supply at the suction port thereof and the one end of the booster at the delivery port thereof.

12. A fuel injection system as claimed in claim 11, in which the pump is driven by a drive to generate the fuel pressure, the system further comprising a fuel pressure control valve controlled by the control means to maintain the delivery pressure of the pump at a controllable level.

* * * * *